US007404349B1

(12) United States Patent
Fiske et al.

(10) Patent No.: US 7,404,349 B1
(45) Date of Patent: Jul. 29, 2008

(54) SYSTEM AND METHOD FOR CUTTING CONTINUOUS WEB

(75) Inventors: John M. Fiske, Wakefield, MA (US); James R. Mazur, Derry, NH (US); Tamas Hetenyi, Concord, MA (US); Edward J. Zanchi, Waltham, MA (US); William F. Bolza, Chelmsford, MA (US); Gregory Mercurio, Billerica, MA (US)

(73) Assignee: Roll Systems, Inc., Burlington, MA (US)

( * ) Notice: Subject to any disclaimer, the term of this patent is extended or adjusted under 35 U.S.C. 154(b) by 401 days.

(21) Appl. No.: 10/994,665

(22) Filed: Nov. 22, 2004

(51) Int. Cl.
*B65H 20/04* (2006.01)

(52) U.S. Cl. ..... 83/236; 83/436.6; 226/154

(58) Field of Classification Search ..... 83/236, 83/262, 436.15, 436.6; 226/154, 155
See application file for complete search history.

(56) References Cited

U.S. PATENT DOCUMENTS 2,019,518 A * 11/1935 Widell ..... 83/236
2,130,700 A * 9/1938 Shackleton ..... 83/236
2,340,819 A * 2/1944 Mills ..... 101/132.5
3,796,117 A * 3/1974 Mukai et al. ..... 83/210
3,804,312 A * 4/1974 Lagergren ..... 226/35
3,857,312 A * 12/1974 Carlstedt ..... 83/236
5,967,394 A 10/1999 Crowley et al.

* cited by examiner

*Primary Examiner*—Ken Peterson
(74) *Attorney, Agent, or Firm*—William A. Loginov; Loginov & Associates PLLC

(57) ABSTRACT

A system and method for cutting continuous web that provides a simplified and direct feed path during loading, and thereafter a more-complex serpentine feed path at an infeed unit for reliable infeed of the web, arranged as either a free loop or a moderately tensioned configuration. Downstream, an indexing drive intermittently pauses the web for the cutter knife to operate. The indexing drive and infeed unit's drive are synchronized by a controller to produce a small horizontally disposed buffer loop therebetween. The buffer loop is maintained within a predetermined range using a sensor, operatively with the controller, that measures the location of the end of the loop, modulating the drives to maintain the buffer loop's (returning) end within a predetermined location about the sensor's sensing field. The system includes an adjustment drive motor for moving a plurality of edge guide sets toward and away from each other in synchronization.

24 Claims, 16 Drawing Sheets

SYSTEM AND METHOD FOR CUTTING CONTINUOUS WEB

BACKGROUND OF THE INVENTION

1. Field of the Invention

This invention relates to web cutters and cutter feeding systems.

2. Background Information

The use of continuous web for high speed printing operations, including print-on-demand and direct mail applications has become extremely popular. A continuous web, held on a driven roll, is driven through a series of stages in which printing and other embellishments are applied in the form of pages or sections of the web. The web can be driven through various printers and other web utilization devices while remaining in its continuous form. Web is generally driven through these utilization devices using a conventional tractor pin feed method in which perforated, pin feed strips along opposing side edges of the web are engaged by tractor pin feed units, or the web can be driven using a pinless feed method and drive, such as that described in U.S. Pat. No. 5,967,394 entitled METHOD AND APPARATUS FOR PINLESS FEEDING OF WEB TO A UTILIZATION DEVICE, by H. W. Crowley et al., the teachings of which are hereby incorporated herein by reference.

At a predetermined stage in the overall web-handling process, the continuous web may be fed from a driven source roll or other upstream source device to a web cutter. The cutter uses a moving knife (typically a guillotine, rotary or sliding type blade) to divide the web widthwise (e.g. laterally or transversely to the direction of movement) into individual sheets of predetermined size. As sheets are cut, they are directed downstream to further utilization devices that may include justifiers, folders, further printers, stackers or sorters. The cutter, or another utilization device, may also include a slitter that divides the web lengthwise into two or more side-by-side ribbons in order to maximize throughput by allowing the cutting and downstream-processing of two or more side-by-side sheets concurrently. The sheets can be subsequently stacked or otherwise handled in a side-by side fashion. In some implementations, a downstream justifier can include appropriate mechanisms for merging the slit sheets into a single feed path. Alternatively, the sheets can be merged prior to cutting, and then cut one-atop-the-other.

Conventional and currently available cutters are limited by a variety of disadvantages. Often, their infeed arrangement from a source involves a tortuous feed path in order to carefully regulate the location of web presented to the cutter. In high-speed operation, the cutter must move quickly and violently to divide the sheets. The tortuous web feed path, when maintained in a moderately tensioned state, is subjected to significant shock by the action of the cutter, which may lead to inaccuracy in the size of cut sheets—as the web is susceptible to sudden jerks during cuts. Similarly where the web is paused to receive a cut from, for example a guillotine-style knife cutter, the drive rate of the cutter section may vary from that of the infeed section. In addition, the tortuous infeed path is difficult to thread during loading and, once threaded, may form a permanent serpentine deformation in the web when it is allowed to stand in the cutter for any significant waiting time. This deformation can adversely affect feeding into downstream devices as the web presents an undesirable curl to the cutter, justifier, etc.

In addition, many cutters must be carefully adjusted at a number of different, discrete locations in order to ensure that the web is properly guided along its side edges. This is often accomplished by the operator through simple and inaccurate manual and visual techniques that may lead to misalignment between guides and off-center feeding. This adjustment problem is exacerbated where a cutter is designed to feed either pin-feed or pinless web. It is, thus, desirable to provide a system and method for cutting continuous web that addresses the various above-described limitations.

SUMMARY OF THE INVENTION

This invention overcomes the disadvantages of the prior art by providing a system and method for cutting continuous web that provides a simplified and direct feed path during loading, but that thereafter moves easily into a more-complex serpentine or S-wrap feed path for reliable infeed of the web from a source that is arranged as either a free loop or a moderately tensioned configuration. The serpentine feed path is provided at an infeed unit that infeeds web from an upstream source at a relatively continuous rate. Downstream, of the infeed unit, adjacent to a moving cutter element, is provided a cutter indexing drive. The cutter indexing drive moves intermittently to momentarily pause the web at the cutter knife until a cut occurs. The cutter indexing drive and infeed drive are synchronized by a controller so as to produce a small horizontally disposed buffer loop therebetween. The buffer loop is maintained within a predetermined range using a sensor, which is operatively connected with the controller, and that indicates the location of the end of the loop, modulating the drives to maintain the buffer loop's (returning) end within a predetermined location about the sensor's sensing field. The buffer loop makes possible a smooth transition from the continuous feed of the infeed drive to the intermittent feed of the indexing drive, while its small size generates minimal inertial load and reduced air resistance, and allows for better loop containment and control of the loop section. In addition, the inventive system includes an adjustment drive motor for moving a plurality of edge guide sets toward and away from each other in synchronization. In particular, the edge guides are adapted to move inwardly and outwardly with respect to a feed path centerline in an illustrative embodiment so that accurate centering of the web is maintained throughout the device's feed path.

In an illustrative embodiment, the infeed unit includes an elastomeric infeed drive roller that is mounted on a pivoting arm assembly having a an arm pivot line about a large-diameter guide bar over which the web passes to wrap around the drive roller in an S-wrap configuration. The drive roller is driven by belts interconnected with an infeed drive motor. A linear actuator or piston swings the arm assembly pivotally about the pivot line between a loaded and an unloaded position. A clutch that is variably driven by the infeed drive motor selectively provides rotational force to an upper pressure roller or nip roller assembly that is pivotally mounted, and that includes a top web guide plate. During rotational motion of the arm assembly, the nip roller assembly is also moved upwardly and downwardly to position the nip roller assembly selectively into and out of interfering engagement with the infeed drive roller as it moves between the loaded and unloaded position. More particularly, the clutch causes the nip roller assembly to move up out of interfering engagement as the drive roller passes by the nip roller assembly and allows the nip roller assembly to come to rest behind the web in the unloaded position, and engagement in a "nip" at the approximate top of the drive roller in a loaded position.

The arm assembly includes a plate that provides a base for extension of the horizontal loop. The plate includes stripping fingers that extend into grooves in the drive roller. The plate also includes a sensor arrangement that communicates with the controller to sense the size of the buffer loop. Downstream of the buffer loop, an indexing drive (consisting of tractor pin feeds, a pinless drive roller or both) is also in communication with the controller. The infeed unit and the indexing drive are driven selectively to maintain the buffer loop within a predetermined loop size range and present the appropriate location to the cutter for separation into sheets.

Also, in an illustrative embodiment, the cutter can be adapted to feed an optional, moderately tensioned infeed web or a free loop infeed web from an appropriate web source. In the case of a free loop web, the web enters directly over the guide rail, and then, wrapped around the inner face of the infeed drive roller and nip roller. A pair of adjustable edge guides are provided to the guide rail. The edge guides are driven selectively by an internal stepper motor via an elongated belt. The internal stepper motor is also connected to a set of edge guides that are directly downstream of the buffer loop. In addition, the stepper motor drives edge guides and/or the tractor pin feed units at the indexing drive section in synchronization with the infeed rail's edge guides. Alternatively, when (optionally) managing a web that enters the infeed unit under moderate tension, the edge guides at the infeed rail may be omitted or moved away and, instead, edge guides are provided at a low position about a 90 degree-bend guide rail near the bottom of the cutter system housing. The 90-degree guide rail includes moving edge guides that are driven by the stepper motor in synchronization the edge guides/tractor pin feed units downstream of the buffer loop at the indexing drive section.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
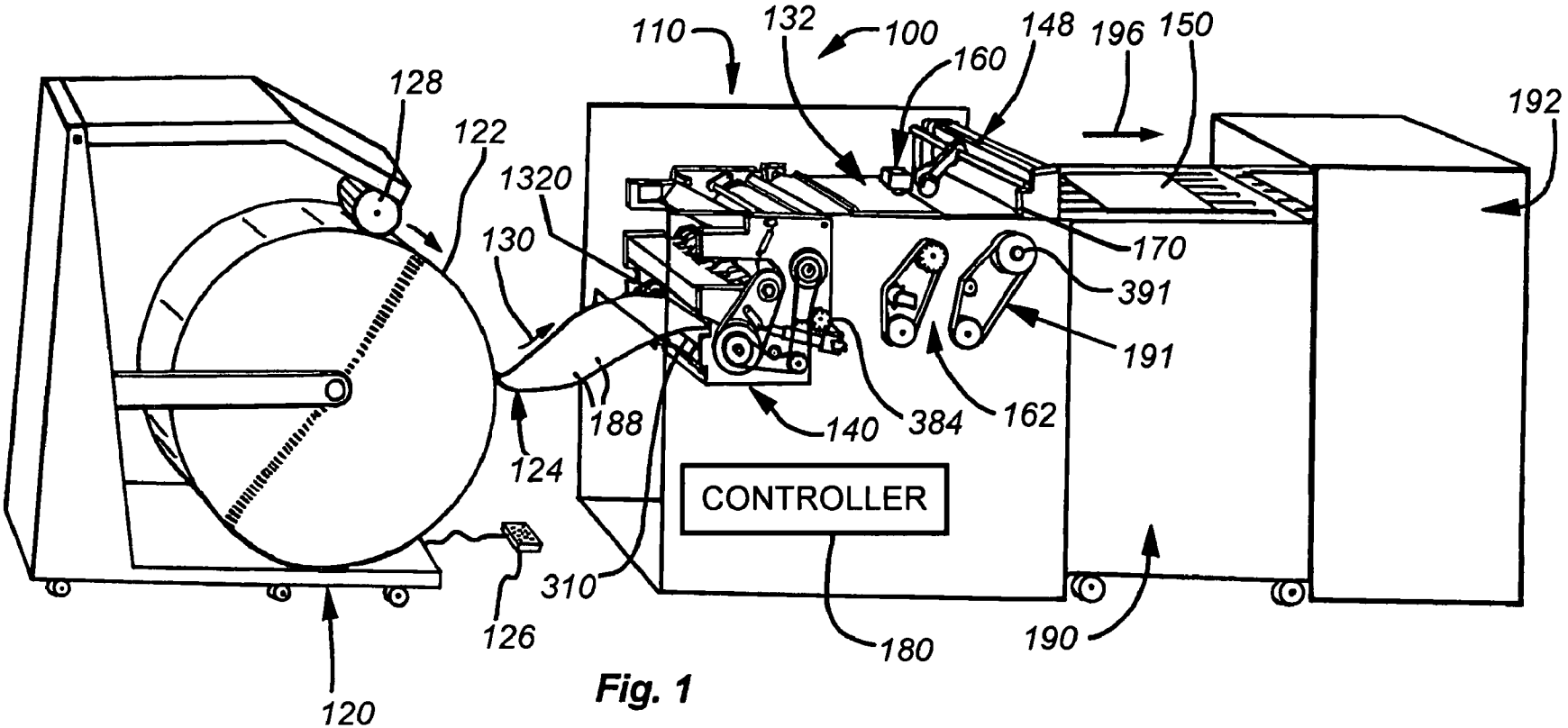
FIG. 1 is a partially exposed perspective view of a system for feeding and cutting continuous web according to an embodiment of this invention, employing an input free loop of web.

FIG. 1 shows an overall web handling system 100 that employs a cutter 110 according to an embodiment of this invention. The system 100 in this simplified embodiment includes a web source that is a driven roll stand 120 that provides web from a roll 122 on demand via a free loop 124 that is monitored by a sensor 126. The sensor 126 can be ultrasonic, optical or any other acceptable sensor-type that modulates the drive element 128 of the stand 120 so as to pay out web according to a desired rate. This source feed rate is typically based upon the draw demand from the cutter and downstream devices. The web is transferred in an upstream-to-downstream direction (arrow 130) through the free loop 124 and into the cutter 110 as needed. The cutter 110 includes an infeed section 140 that directs web from the free loop into the infeed unit 140 of the cutter (described in detail below) and upwardly through an upper indexing drive section 132, and finally through a cutter element 148. The cutter element 148 can be implemented in any appropriate cutter that divides the web transversely to the downstream direction along widthwise separations into sheets 150. In this embodiment, the cutter element 148 comprises a guillotine-style cutter that drives a knife (see knife 333 between guides 335 in FIG. 3) downwardly (arrow 337), and a base element (not shown) upwardly across the width of the web at predetermined intervals. A motor 339 that is internal to the housing of the cutter 110 and an associated crank arm (not shown) provide motive force for the knife 333. Alternatively, rotary or crosscut cutters can be employed. The web is directed into the cutter using an indexing drive mechanism that is shown in this illustration (described in detail below), in part, by a pinless drive unit 160 and an interconnected motorized drive belt mechanism 162. In addition, the indexing drive mechanism can include peripheral tractor pin feed units (also described further below) where the web is provided with conventional pin feed holes along its side edges. The cutter unit can include a slitter 170 of conventional design that divides a wide web into two more-conventionally sized sheets (for example, 8½-inch width sheets) derived from a 17 to 18-inch web.

As will also be described further below, a controller 180 is used to monitor and regulate the drive speed, and other functional aspects of the cutter 110. The controller 180, in particular, regulates the relative speed of the infeed unit 140 with respect to the indexing drive section 132 and cutter element 148. For the purposes of this description, the term "controller" shall refer broadly to one or more processors that, in the case of a plurality of discrete processors, may or may not communicate with each other. The processor(s) can be implemented as software-driven or firmware-driven microcontrollers and/or state machine logic chips. For example in an illustrative embodiment, the "controller" can be a group of varied processors (not all of which communicate with each other) that control discrete functions of the cutter 110 and are collectively termed the "controller" 180.

In one embodiment, the feed rate of the indexing drive and/or infeed unit 140 is regulated by the controller 180 using a series of equally-spaced printed marks 188 on the web in a manner described generally in U.S. Pat. No. 5,967,394 entitled METHOD AND APPARATUS FOR PINLESS FEEDING OF WEB TO A UTILIZATION DEVICE by H. W. Crowley, et al. the teachings of which are expressly incorporated herein by reference. In the case of a pin feed unit, speed is regulated by the input rate of the tractor pin feed units in the indexing drive section 132 and appropriate adjustments are made to the infeed unit 140 based upon that rate.

In general, the indexing drive (132) operates (typically) at a relatively constant speed, but intermittently so that the web is momentarily paused, with its sheet separation location presented to the cutter element 148. In the case of a moving knife, this pause ensures that the web is stationary during the cut. Hence, the web is "indexed" with respect to the cutting element knife. Conversely, the infeed drive tends to move relatively continuously, drawing web from an upstream source either via a free loop (124) or an optional moderately tensioned loop (see FIG. 2). As will be described in detail below, an intermediate web buffer within the cutter's feed path allows for the speed and drive rate differences between the infeed drive and the indexing drive.

In the exemplary system 100, the cut sheets 150 output from the cutter 110 can be directed to a justifier 190 or other appropriate sheet-handling unit. The sheets 150 pass along the justifier or other unit and are aligned appropriately for input into a further processing device or "utilization" device 192. This further processing device or utilization device 192 can be a stacker, embosser, printer, sorter, collator or any other device that handles cut sheets. Likewise, the web roll 122 can provide a printed or unprinted web that has been generated by earlier processes. In one particular example, the web is initially printed on a roll-to-roll process by an electronic printer or conventional printing press complete with the marks 188 as shown and then directed through the cutter 110 and then downstream (arrow 196) for further processing by the device 192.

Figure 2:
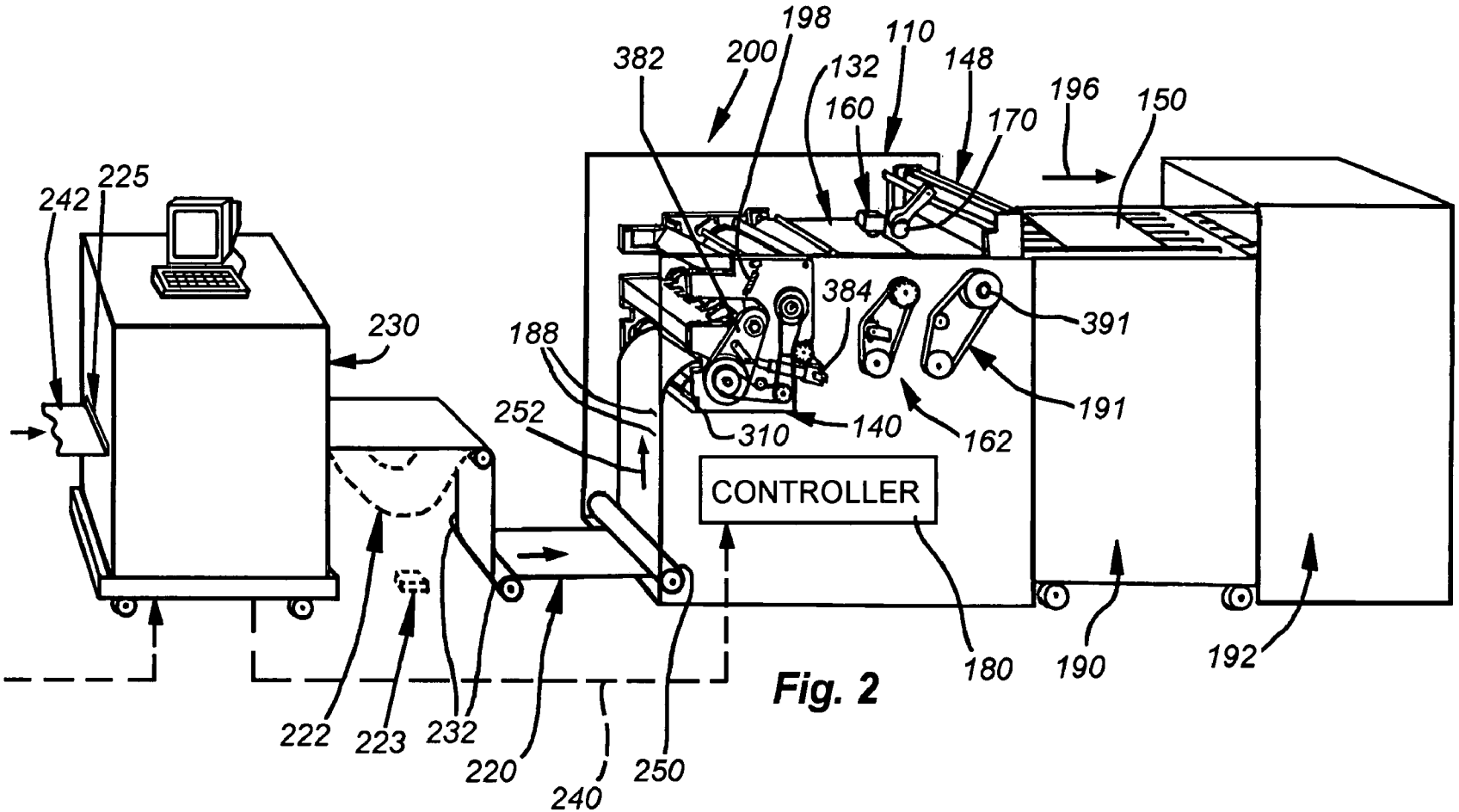
FIG. 2 is a partially exposed perspective view of an optional feeding arrangement for the system for feeding and cutting continuous web according to an embodiment of this invention, in which the system's infeed unit manages the feeding thereinto of a web under tension.

While FIG. 1 shows a free loop 124 input into the cutter 110, an optional arrangement of the system (200) is shown in FIG. 2 in which the cutter 110 manages a web 220 under moderate tension output from an upstream device, such as the electronic printer 230. In this embodiment, a series of guide rollers or bars 232 can be used to direct the web in a manner that moderate tension is retained thereon as it enters the cutter 110. In this example, a communication link 240 (shown a dashed line) is provided between the device 230 and the controller 180. In addition to, or alternatively, registration marks 188 can be provided to the web, as described above. The continuous web 220 may enter the device 230 from a further upstream source, as indicated by the entering web section 242. This entering web section may originate at a driven roll stand or other appropriate source. In this embodiment, a lower input feed guide or "90-degree" guide bar 250 is provided adjacent to the base/bottom of the cutter housing. The web passes upwardly (arrow 252) into the infeed unit 140, and then into the indexing drive as described above. The rollers or bars 232 can direct the web in a straight line or through a series of bends including a 45-degree roller or bar that generates a 90-degree (approximately) bend upwardly in the web 220. Note that in the case of a web being managed by the system under moderate tension, the web's downstream feed may be controlled by an upstream free loop and size sensor. For example a free loop 222 (shown in phantom) and associated loop size sensor 223 (also shown in phantom) are provided between the printing device 230 and the cutter 110. Alternatively, a sensing loop can be provided upstream of the printing device 230 either adjacent to the input side 225 of the device 230 or at another location upstream of the Web infeed arrangements employing both a free loop web and an optional moderately tensioned web are described further below.

Figure 3:
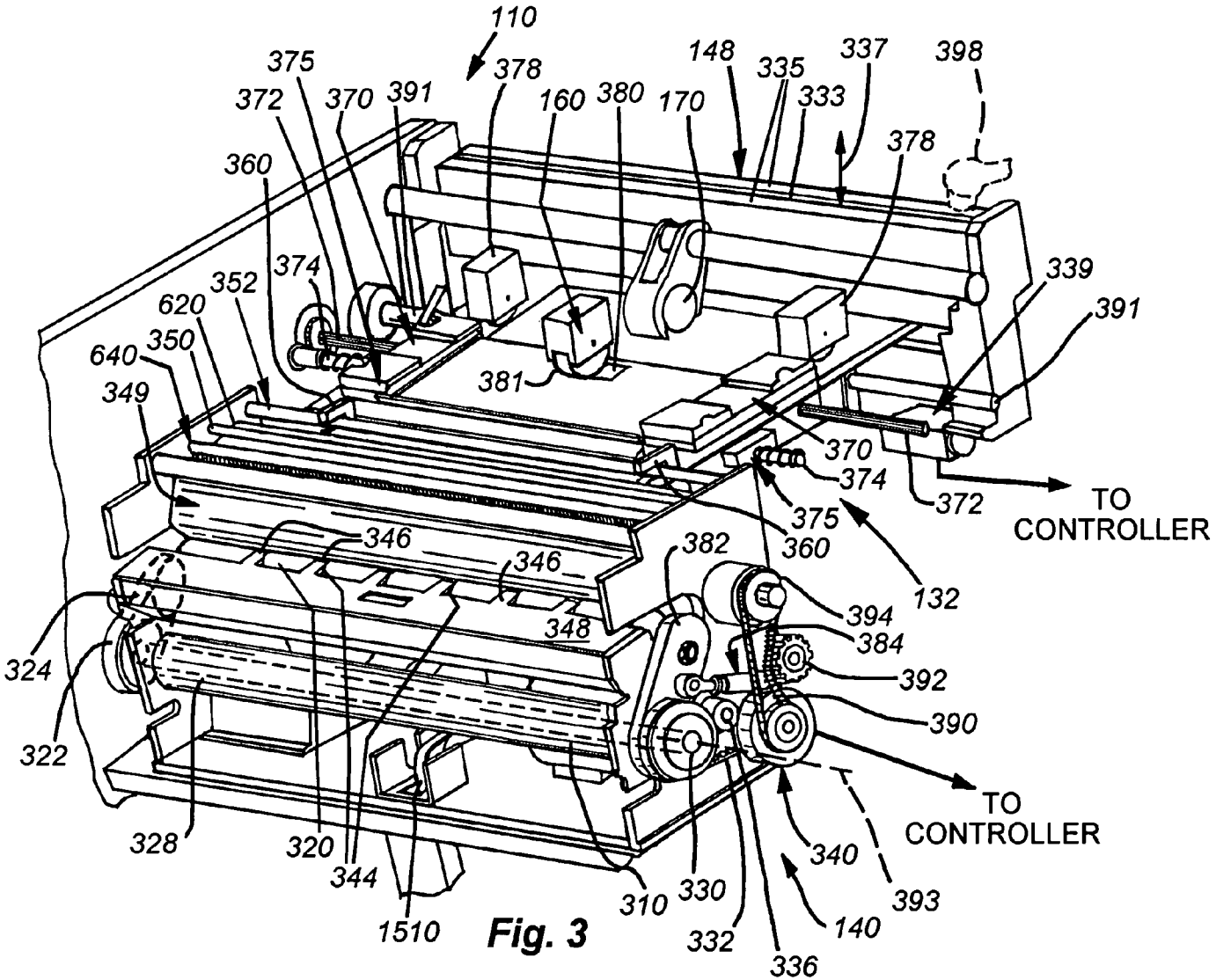
FIG. 3 is a partially exposed perspective view of the cutter mechanism including infeed and cutter indexing edge guide elements.

FIG. 3 shows the generalized infeed unit 140 and downstream indexing drive section 132 in further detail. In this example, the unit is set up to receive the optional moderately tensioned web as shown generally in FIG. 2. However, the principles described herein are generally applicable to either a free-loop or moderately tensioned infeed web arrangement with modifications mainly to the guide bar arrangement and associated guide bar edge guides, as described further below. The infeed unit 140, in particular, is shown in a closed position ready to feed web. A guide bar 310 provides an input around which the web passes from a source, and then wraps around the inner-facing surface of the elastomeric infeed drive roller 320. The guide bar is constructed from smooth polished metal in this embodiment and has an outer diameter between approximately one inch and five inches. Other outer diameters are expressly contemplated. While not shown in this illustration (see FIG. 14), the bar 310 can be fitted with adjustable edge guides (described below) for feeding directly from a pending free loop (as shown in FIG. 1). The infeed drive roller is constructed from a resilient-but-durable, high-friction material such as polyurethane. The infeed drive roller 320 has an outer diameter between approximately 3 inches and 6 inches in various embodiments, while other sizes are expressly contemplated. The infeed drive roller 320 is rotationally driven via a belt 322 that engages a roller end pulley 324 (shown in phantom) on the far side of the FIG. 3 illustration. A drive shaft 328 (shown in phantom) with appropriate bearings (not shown) passes through the rail from a driving pulley 326 on the far side (driving the belt 322). The opposite end of the drive shaft 328, on the near side of the illustration, engages a driven pulley 330 that is engaged by another belt 332. The near belt 332 is, itself driven by a pulley (described below) that is in-line with the infeed drive motor and a clutch 340. The belt 332 also includes a conventional tensioner roller 336 in this embodiment.

The elastomeric infeed drive roller 320 is formed with diametral grooves 344 between approximately ½ and 1 inch in width and ¼-½ inch in depth. The grooves 344 provide channels for receiving conforming stripping fingers 346 that extend inwardly from a guide plate 348. The guide plate provides a rest for a small web buffer loop (shown and described below) that extends approximately horizontally along the plate. The loop exits from between the drive roller 320 and a pressure roller or nip roller (422 below) enclosed by a pivoting assembly 349 and passes back over guide bars 350 and 352 at the top of the infeed unit 140. The geometry of the feed path and guide elements is described in further detail below. In general, a guide bar assembly having a pair of movable edge guides 360 is provided at the end of the infeed unit 140.

A pair of relatively conventional tractor pin feed drive units 370 are provided for feeding conventional pin feed web at the indexing drive section 132, just upstream of the cutter element 148. These units are adjustable toward and away from each other to accommodate differing web widths, riding on a transverse guide bar 372 that comprises a driven splined shaft in this embodiment. A lead screw 374 engages a threaded block or nut assembly 375 on each of the units rotates to move the units 370 toward and away from each other in a manner described in further detail below. This lead screw, and others described herein, in combination with driven an/or fixed guide rods acts as a linear positioning device, establishing a selected width adjustment for components that conforms to a relative width of the input web.

A pair of pin feed strip trimmers 378 are also provided upstream of the cutter element 348 for removing such pin feed strips when they are provided to the web. The trimmers 378 rotate under the power of a driven shaft 391 that can be splined to allow the trimmers 378 to slide toward and away from each other in conjunction with the tractor pin feed units 370. The trimmers 378 can also be unhitched (using movable latches (not shown)) from the tractor units 370 and moved outwardly out of contact with the web when not in use. A motorized belt assembly 191 (See FIG. 1 and further description with reference to FIG. 5 below) is provided to drive the trimmers 378 via the shaft 391

For pinless web, the tractor pin feed units 370 can be set so that the pins or other edge guides ride away from, or just-barely contact, the pinless edges of the web. In such a pinless-feed configuration, the web is driven by a centered pinless drive 160, including an under-mounted central drive roller 380 (that is driven by the splined shaft 372) and spring-loaded overriding nip roller 381. The tractor pin feed units 370 and pinless drive 380, 381 are interconnected via an indexing drive motor (510 below), and the indexing drive motor is operated by the controller 180 in a manner also described further below.

The infeed drive roller 320 is pivotally mounted on a pair of swing arms 382 on each of opposing sides (far and near sides of the FIG. 3 view) of the infeed unit 140. The arms pivot on a pivot line that is in line with the central axis 393 of the guide bar 310. The arms 382 move between a fully closed (feed-ready) position, as shown in FIG. 3 and a fully open, load-ready position (described and shown below). Pivoting of the arms is powered by a linear actuator or piston 384 mounted on the side frame of the unit 140. The actuator 384 is controlled by the controller 180, and it can be powered by pneumatics (or another suitable power source).

The infeed drive motor (440 below), via the clutch 340 also drives a belt 390, tensioned by a tensioner 392. The belt 390 selectively rotates a pulley 394. As will be described in detail below, the pulley 394 rotates the infeed unit's nip roller assembly 349 to move in into and out of (typically above) engagement with the main infeed roller 320 during loading and unloading of the infeed unit 140.

The motion of the infeed unit 140 during web-loading/feeding and web-unloading/idle will now be described in further detail with reference to FIGS. 4-11. In general, it is recognized that the tortuous serpentine feed path produced by the infeed unit 140 generates tight bends in the web that would make loading difficult if maintained at all times, and that would also tend to form permanent undesirable curling in the web during idle periods where the web remains loaded (under certain conditions of heat and humidity in particular) but stationary in the unit. Thus, the invention provides a mechanism for allowing a more-direct, unwrapped feed path during loading and idle periods. According to this invention, the feed path is quickly and reliably converted back to the desirable S-wrap path when web-movement/cutter-feeding occurs.

Figure 4:
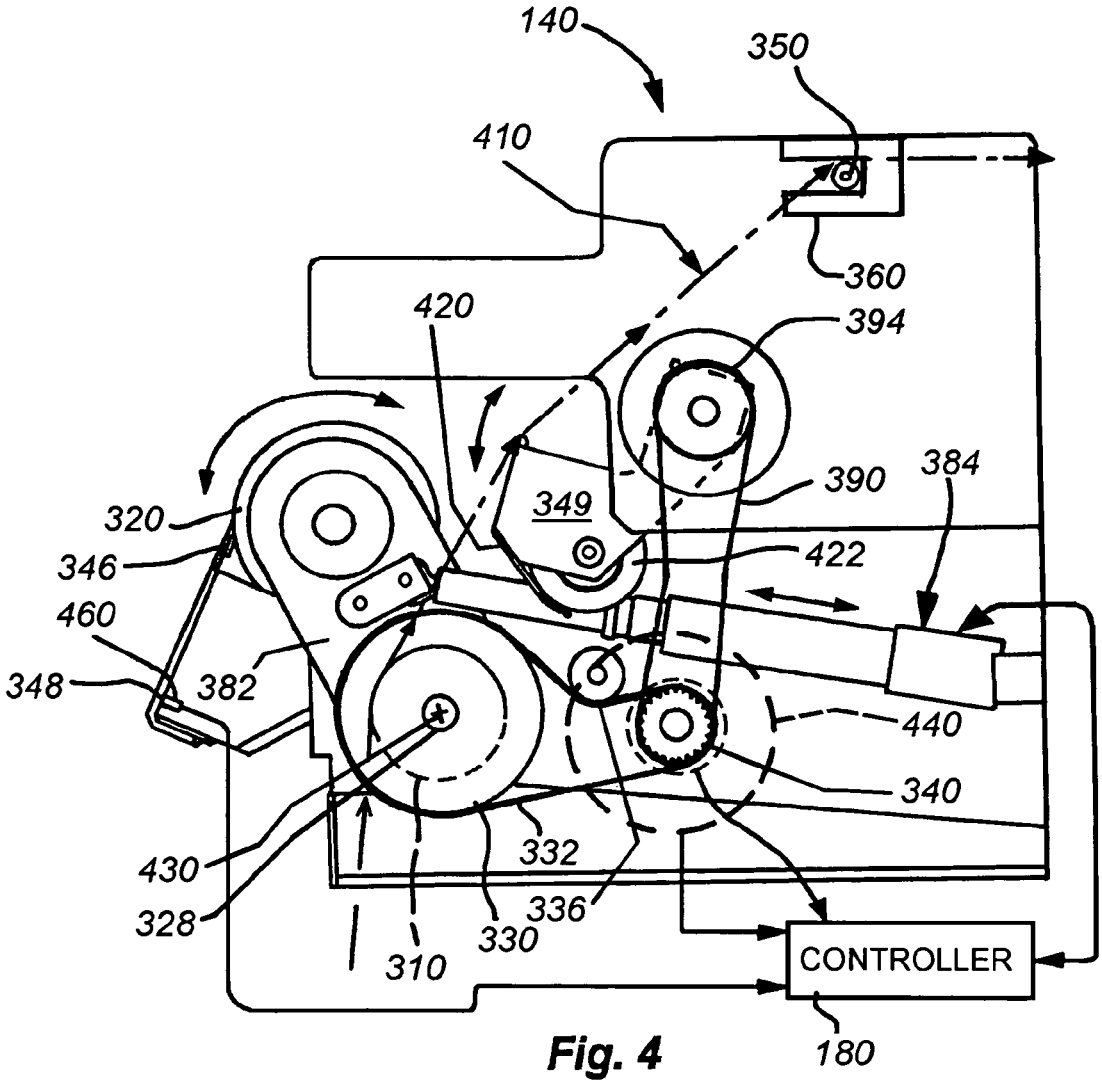
FIG. 4 is a partial side view of the infeed components showing a feed path during loading.

As shown in FIG. 4, the infeed unit 140 is in a fully opened, ready-to-load position. In this position, the arms 382 are moved outwardly from the unit 140 to locate the drive roller 320 out of engagement with the web 410. Likewise, the pressure roller or nip roller assembly 349, which includes a top plate 420 and the freewheeling metal nip roller (sized between approximately 1 and 3 inches in diameter in one embodiment) 422 is dropped inwardly away from the top side of the infeed unit 140. To drop the assembly 349, the controller 180 removes the clutch's tension from the belt 390, thereby allowing the assembly to drop into the position illustrated in FIG. 4. Likewise, the linear actuator 384 has moved outwardly to pivot the arms 382 about the axis 430 taken through the shaft 328 and overlying guide bar 310. In this position, the web 410 is relatively unbent, depending with a slight bend from the guide bar 310 and upper edge guide bars 350 and 352. This position allows the web to remain at idle without significant deformation. It also allows a new web end to be loaded for the first time with relative ease by simply passing it up along the guide bar 310 and over the top edge guide bar 350 without need to thread the web end around the serpentine path that takes shape during a normal feeding operation.

The infeed drive motor 440 is shown in phantom, residing within the housing of the infeed unit at a convenient mounting location. It is operatively interconnected with the controller 180, which directs the speed, direction (e.g. forward or reversing action) and timing of the motor's operation. In addition, the controller 180 is interconnected with the linear actuator 384 and the clutch 340 (also shown in phantom). Likewise, a loop sensor 460 is provided to the horizontal loop rest plate 348, and this sensor 460 operatively communicates with the controller. As will be described below, the loop sensor 460 allows the controller to regulate/modulate the infeed drive in conjunction with the indexing drive, so as to maintain a desired loop size over the plate 348.

Figure 5:
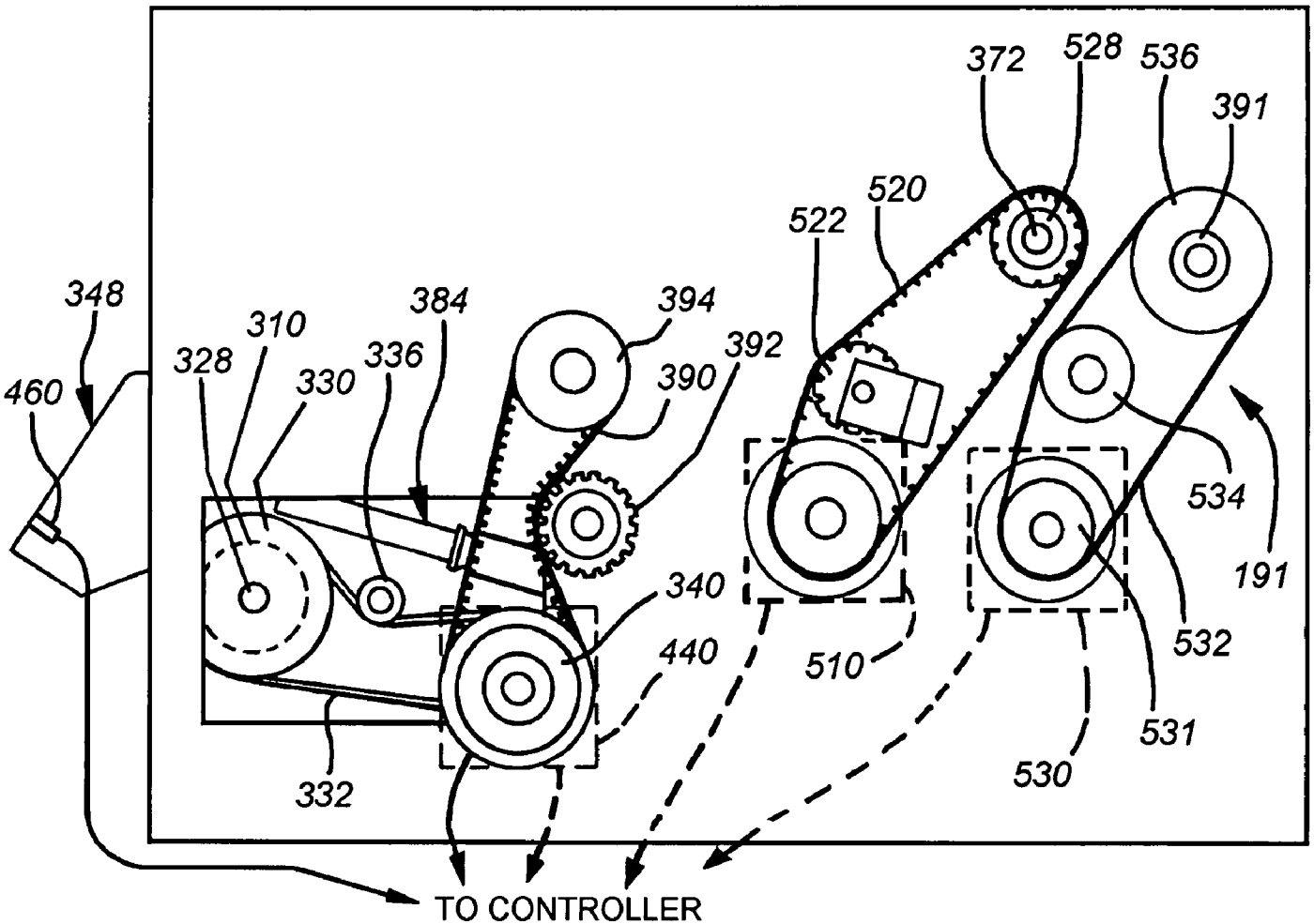
FIG. 5 is a partial side view showing various belted mechanical interconnections between rotating components.

With reference now to FIG. 5, the exterior of the infeed housing is shown. While drive components may be located at any appropriate point within the housing, the illustrative embodiment depicts three sets of main drive belts positioned externally for easy access. The pressure roller or nip roller assembly (449) drive belt 390 is shown. It is interconnected with the clutch 340 and upper driven pulley 394 and also to the infeed drive motor 440 that communicates with the controller 180. An indexing drive section (132) motor 510 is also provided. It is also interconnected with the controller 180, as shown. The indexing drive motor 510 connects to a drive belt 520 that is tensioned by a tensioner 522. A driven pulley or sprocket 528 is provided at the upper end of the assembly. This drive sprocket is interconnected to a main drive roller (380) of the pinless drive (160) and also to the tractor pin feed drives units (370) via the splined shaft 372. The indexing drive motor 510 can be operated at various speeds so that, in combination, the infeed drive motor 440 and indexing drive motor 510 can maintain a desired buffer loop in the web of predetermined size (which is regulated by the sensor 460, described below), track the location of web sheet separation locations for the cutter element 148, and also respond to the inputs of an upstream utilization device as needed. Note that in certain embodiments, an upstream utilization device transmits synchronization or control signals to the cutter, which the controller responds to in regulating its own feeding.

As noted above, the cutter element 148 is synchronized with the indexing drive section 132 to cut sheets at predetermined separation locations and/or spacings. These spacings can be provided through encoder signals generated by the indexing drive motor 510 and/or by marks printed on the web and used in a manner described generally in the above-referenced METHOD AND APPARATUS FOR PINLESS FEEDING OF A WEB TO A UTILIZATION DEVICE.

Referring briefly to FIG. 3, the cutter motor 339 also responds to signals from the controller 180 and is connected by a crank arm and other conventional linkages (not shown) to the downwardly moving, reciprocating knife (double arrow 337). This motor is used to drive the cutter element knife 333 within its guide frame members 335 to make widthwise cuts on the web. As described above, the cutter element can be implemented as a variety of conventional units. In this embodiment, a guillotine-style cutter as shown (cutter element 148 and blase 333) is employed.

As described briefly above, a drive assembly 191, consisting of a drive motor 530, pulley 531, belt 532, tensioner 534 and driven pulley 536, is provided to drive the shaft 391. The shaft 391 continuously drives the above-described trimmers 378, which can be implemented as conventional rotating blade wheels.

Figure 6:
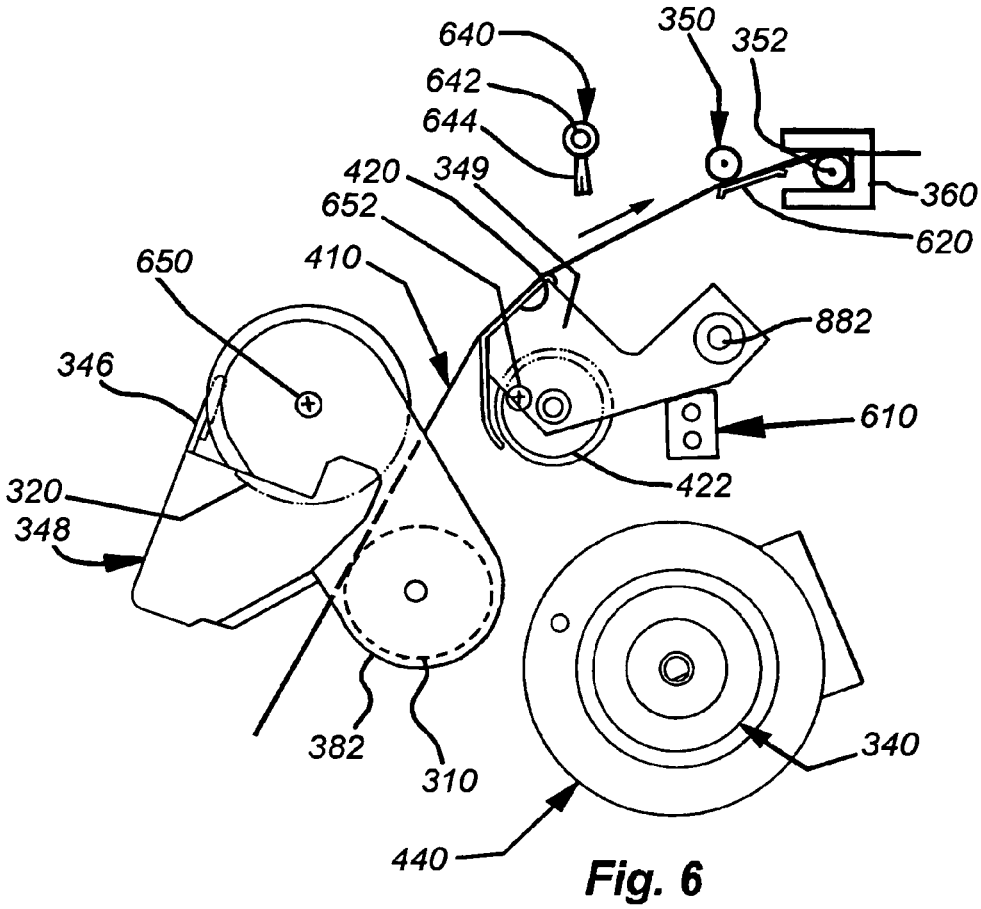
FIG. 6 is a partial side view of a feed path during loading.

With reference now to FIGS. 6-11, the opening and closing of the infeed unit is described in further detail. FIG. 6 shows an initial loading or idle position in which the web 410 is unwrapped from the infeed drive elements. The web 410 rests on the guide bar 310 out of engagement with the main drive roller 320, which is fully opened on its arm assembly 382 under bias of the actuator 384 (described above). The nip roller assembly 349 is dropped fully down onto a stop assembly 610 where is sits slightly contacting the rear face of the web 410 without substantially projecting into the relatively straight (unwrapped) feed path. Accordingly, the web 410 is shown generally flattened without substantial bends or creases. Note that it passes upwardly over the top plate 420 of the lowered nip roller assembly 349 in its dropped position. The web passes from its slight contact with the assembly's (349) top plate 420 under the front guide bar 350, and then between this guide bar and an upwardly angled guide plate 620. Downstream of the angled guide plate 620, the web 410 passes over a second guide bar 352 in the area of the edge guides 360. The edge guides need only extend around the guide bar 352 to provide adequate lateral directing of the web.

A brush assembly 640 is also shown in FIG. 6. When the top plate 420 is in its uppermost position, the bristles 644 of the brush assembly 640 pressurably engage the top surface of the web to maintain drag pressure on the web so as to stabilize the upper end of the buffer loop. The brush assembly 640 is pivoted about a pivot rod 642. As shown in FIGS. 1 and 2, a tension spring 198 is used to maintain torsion on the brush. This spring can be adjusted to adjust the relative pressure of the brush on the web surface. The axis of rotation 650 of the elastomeric drive roller 320 is shown in its actual position when the arm 382 is moved fully away from the loaded position and also in the loaded position as axis 652. As the various movement positions of the arm 382 are described, reference will be made to the actual position 650 of the roller's axis and its final closed or loaded position 652.

Figure 7:
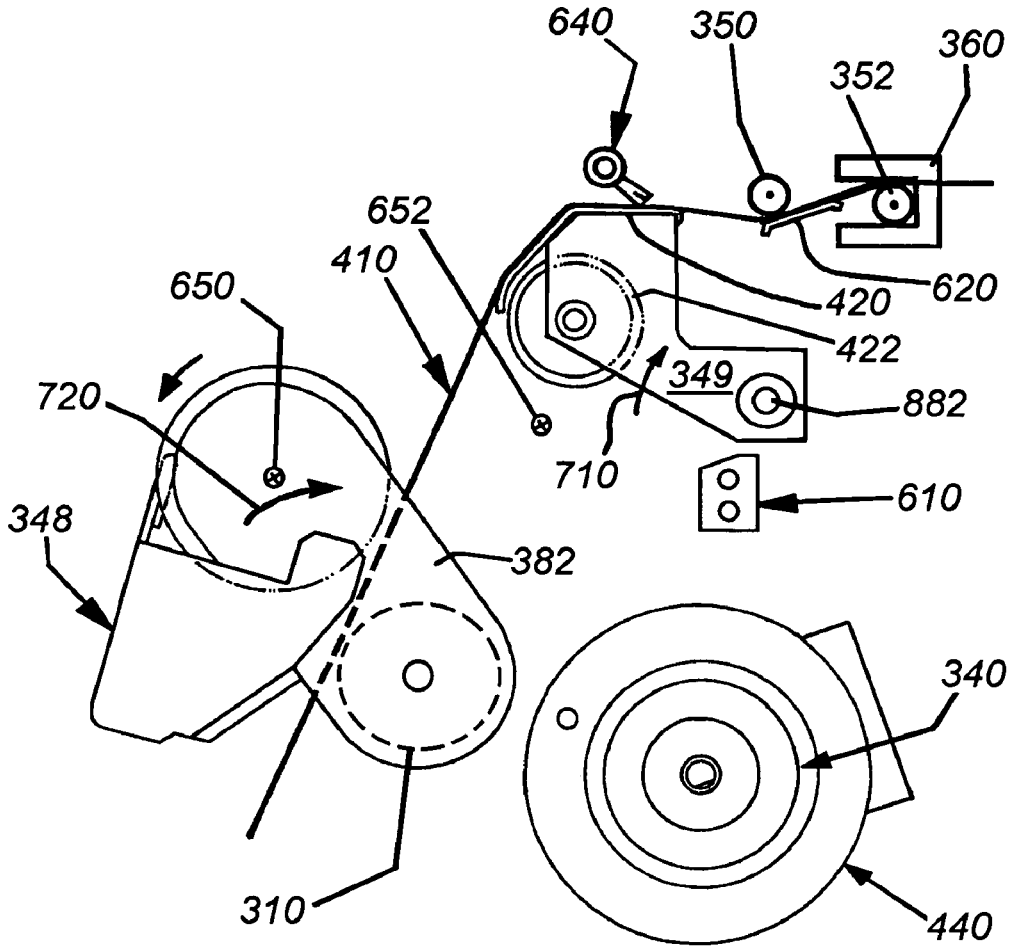
FIG. 7 is a partial side view of the feed path as loading occurs and infeed rollers are moved into a loaded orientation.

During the subsequent loading sequence, as shown initially in FIG. 7, the clutch 340 is engaged as the infeed drive motor 440 rotates. This causes the nip roller assembly 349 to pivot upwardly about pivot point 882 (curved arrow 710) to bring the top plate 420 into engagement with the brush assembly 640. At this time, the brush assembly rotates against the bias of the plate 420. The arm 382 begins to move inwardly (curved arrow 720) to bear on the surface of the web 410.

Figure 8:
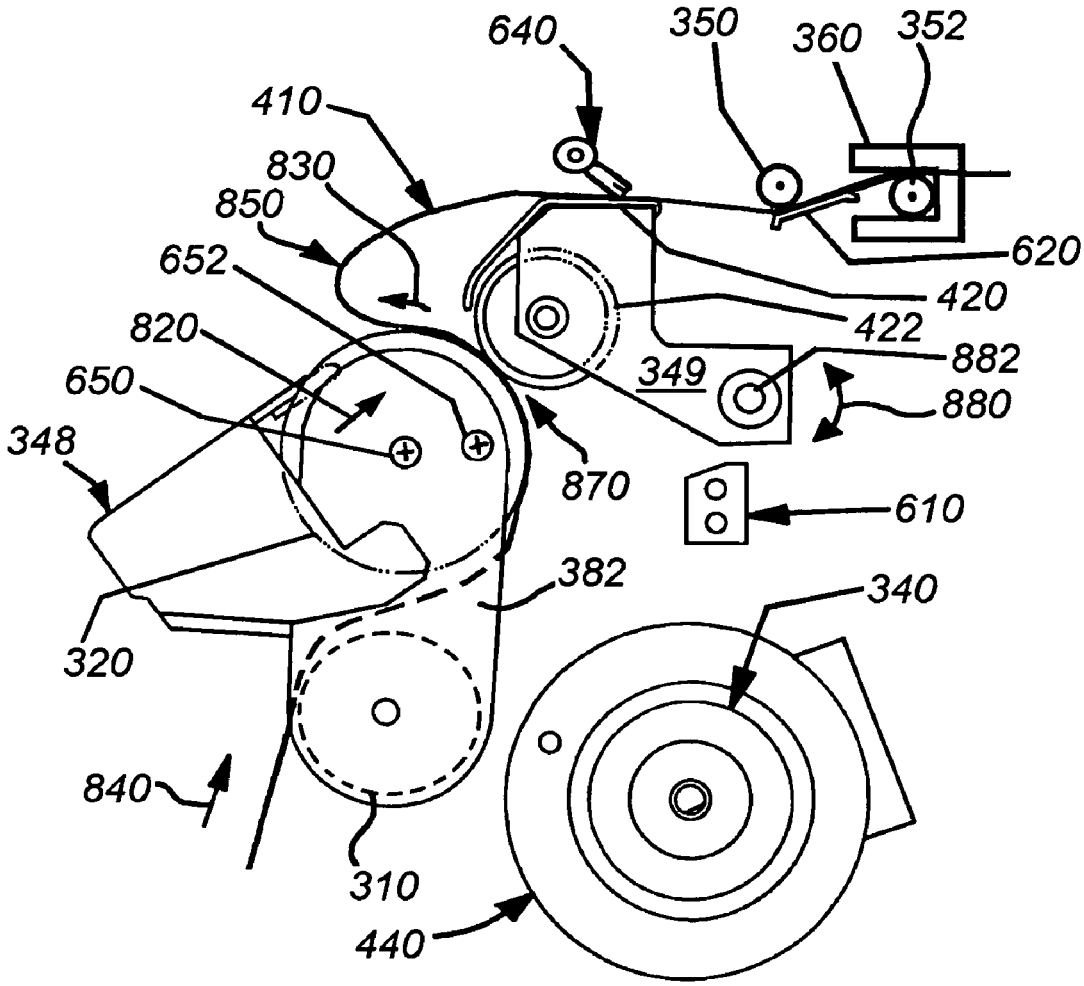
FIG. 8 is a side view showing the elements of FIG. 7 moved further into a loaded orientation.

In FIG. 8, the actual roller axis 650 has moved substantially closer to the fully closed axis 652. The nip roller 422 begins to ride on the inner surface of the web 410 against the pressure of the drive roller 320. During a movement of the arm assembly 382 (arrow 820) the drive motor 440 tends to rotate a roller 320. This causes web to be drawn upwardly (arrows 830 and 840) into a loop 850 between the top plate 420 and the nip 870 formed between the rollers 422 and 320. At this time, the clutch 340 may be released, allowing the nip roller 422 to move against the drive roller 320 under its own weight. The brush assembly 640 follows the relative movement as the assembly 349 pivots (curved double-arrow 880) about its pivot point 882.

Figure 9:
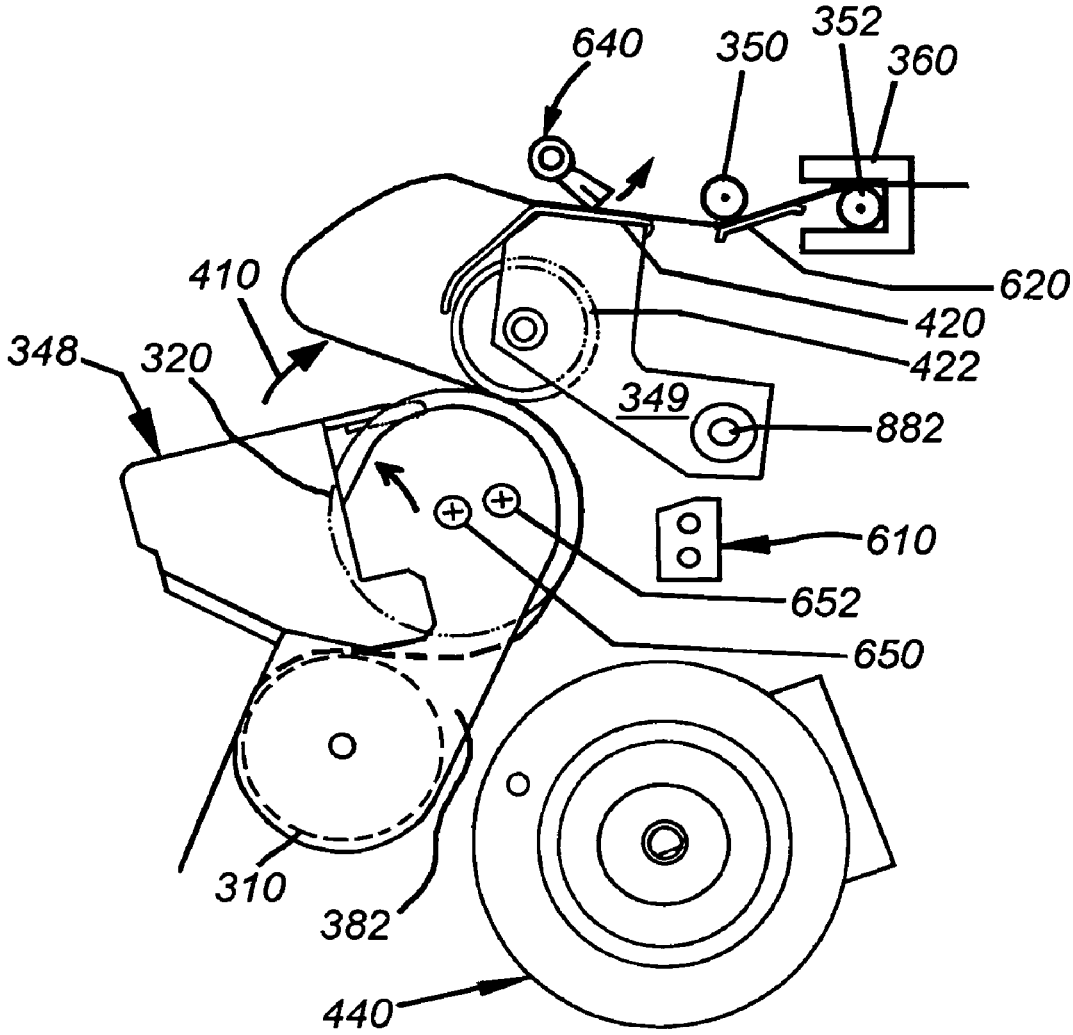
FIG. 9 is a side view showing the elements of FIG. 7 moved further into the loaded orientation.

In FIG. 9, the axis actual roller 650 moves substantially closer to the fully loaded/closed axis 652. At this time in the loading process, the web 410 assumes a significant S-wrap around the guide 328 and elastomeric roller 320. The nip roller assembly 349 has moved further upwardly under coordinated/synchronized action of the clutch 340 to avoid interfering with periphery of the swinging infeed drive roller 320, and the loop becomes larger under relative rotation of the roller 320. The horizontal loop rest plate 348 is moving into a relatively horizontal position beneath the loop as an integral part of the overall swing arm assembly 382.

Figure 10:
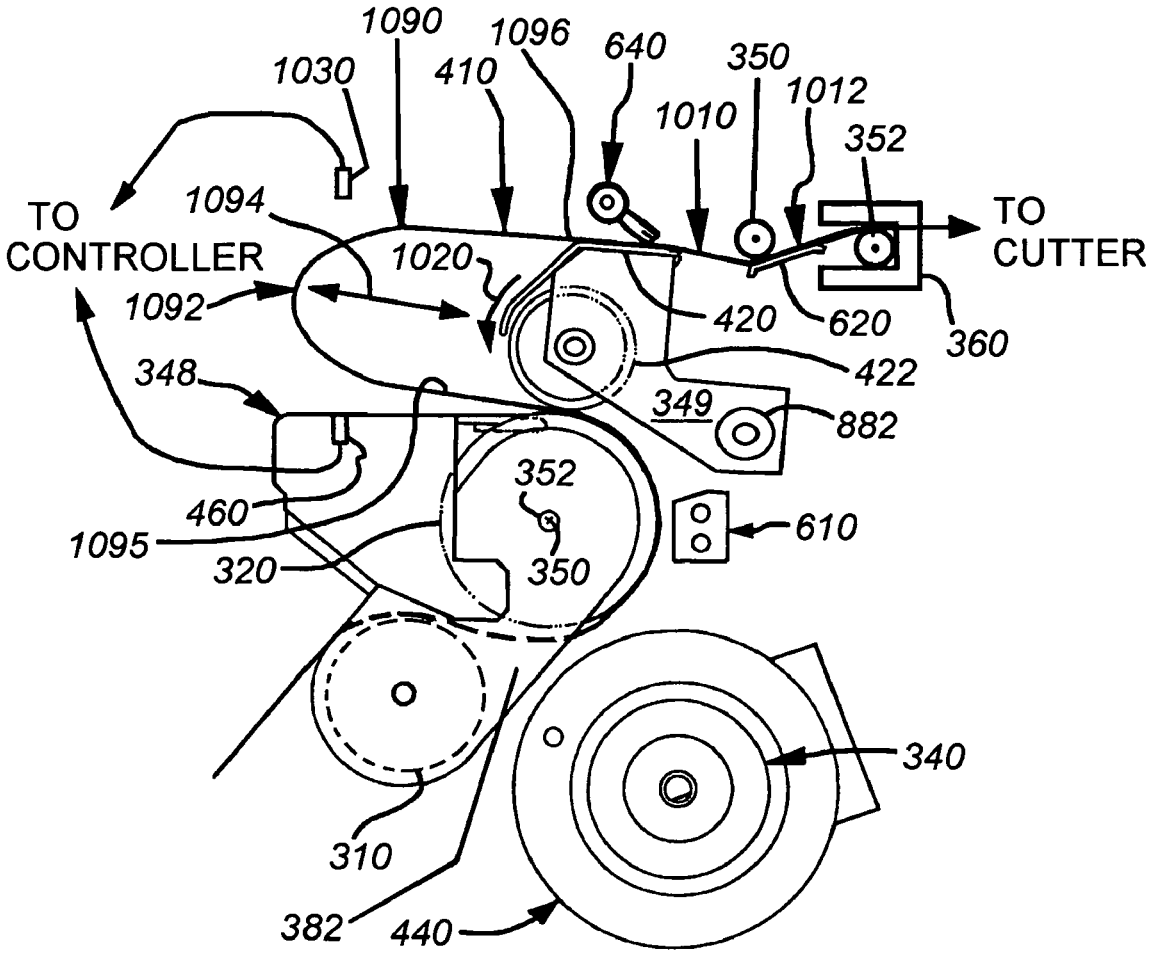
FIG. 10 is a side view showing the elements of FIG. 7 moved into the loaded orientation with the formation of a buffer loop.

In FIG. 10, the actual and loaded drive roller axes 350 and 352 have become concentric, meaning that the arm assembly 382 is now in its final closed position. The clutch has disengaged and the infeed drive motor 440 has stopped causing the nip roller assembly 349 to drop (arrow 1020) into its final position resting over the approximate top of the drive roller 320. This forms the appropriate web-driving nip between the nip roller 422 and the drive roller 320. The weight of the assembly 349 maintains desired pressure on the nip, but additional springs and/or weights can be provided where appropriate to increase nip pressure. The plate 348 is now in an approximate horizontal position ready to support the buffer loop 1090 and scan the loop with the sensor 460. Alternatively, an overriding sensor and/or beam transmitter 1030 can be provided above the buffer loop to scan it.

Referring further to FIG. 10, the brush assembly 640 applies appropriate pressure against the web 410 relative to the assembly (349) top plate 420. The web section exiting the top plate 420 passes under the guide bar 350 and against the underlying angled guide plate 620 so as to form a slight downward bend in the region 1010 of the web 410. The region 1012 downstream of the first bar 350, in turn, rides up the guide plate 620 to form a slight upward bend around the bar 350 into the downstream guide bar 352. As noted above, the edge guides 360, which (in this embodiment) are an extension of the tractor pin feed units 370, provide lateral edge guiding to the web 410 adjacent to the downstream guide bar 352. The overall approximate S-wrap formed between the top plate 420, guide bar 350 and guide bar 352 add further stability to the web along the lateral direction and further ensure proper guiding into the cutter element 148.

The upward and downward movement of the nip roller assembly 349 about its pivot 882 is regulated generally by the action of the clutch 340 while the drive motor operates (upward movement being by clutched action of the motor 440 and downward movement being by unclutched droppage due to gravity. The timing of clutch operation can be regulated in a number of ways. The controller can respond to sensors (not shown) that track the movement of the arm to different locations and thereby signal upward and downward movement of the nip roller assembly 349. Alternatively, the clutch may be operated based upon a predetermined timing program that is coordinated with the linear actuator 384 or motor 440. In general, the clutch 340 is operated to enable the assembly 349 to move upwardly from the stop 610 so as to prevent interference with the arms 382 and roller 320 as they swing inwardly for loading and to allow the assembly 349 to drop behind the web and thereby flatten the feed path of the web when the arms 382 and roller 320 swing outwardly. In general, the clutch may raise the assembly 349 sufficiently high so that the roller passes thereunder without binding on the nip roller 422, while allowing the assembly 349 to subsequently drop, either onto the rest 610 or onto the top of the roller 320 to form the driving nip (in the unloaded and loaded positions, respectively).

In the closed or loaded position, shown in FIG. 10, the buffer loop 1090 of web 410 is formed over the plate 348. As defined herein the loop is said to extend "horizontally" or in a "horizontal" direction. In other words it extends generally along the direction of the arrow 1094 between the two entry ends 1095 and 1096 and 180-degree end curve 1092. The direction of this arrow is approximately horizontal with respect to the direction of gravity. In this embodiment, the approximate length of the steady-state horizontal loop (taken in the horizontal direction) is between approximately 3 inches and 8 inches, although a wide range of loop sizes are expressly contemplated. This allows for a compact and controllable buffer loop design as shown. The sensor 460 (and/or 1030) signals a controller when the curved end 1092 of the loop 1090 extends through its sensing field. This indicates to the controller that the web has grown large enough and the infeed drive motor 440 and/or the indexing drive motor 510 is modulated to maintain the appropriate loop size. Conversely, when the buffer loop passes fully out of the sensor's field 460, the controller determines that not enough loop material is present and, again, modulates the motors to generate the appropriate loop. In practice, the loop is maintained in a rapid pulsing fashion so that the end 1052 remains barely within the sensor field. This horizontal buffer loop advantageously provides desirable shock-absorption as the web is cut into individual sheets. In general, the horizontal buffer loop isolates the upper indexing portion of the web entering the cutting mechanism from the lower infeed portion making for a smoother presentation of the appropriate separation section of web to the cutter without the overwhelming drag that may be present from the large-diameter infeed roller 320.

Advantageously, since the infeed drive operates is a relatively continuous drive while the indexing drive operates as an intermittent drive, the horizontal buffer loop makes possible a smooth transition from the continuous infeed to the intermittent indexing feed. Notably, due to the buffer loop's relatively small size, the buffer loop also reduces the load on the indexing portion of the web (indexing drive section 132). This reduction in load results, in part, from the buffer loop's small size provides a minimal inertial load and reduced air resistance as the loop size modulates during runtime. In addition the horizontal geometry of the buffer loop allows for good control and containment of the loop, thereby preventing unwanted twisting and distortion.

Figure 10A:
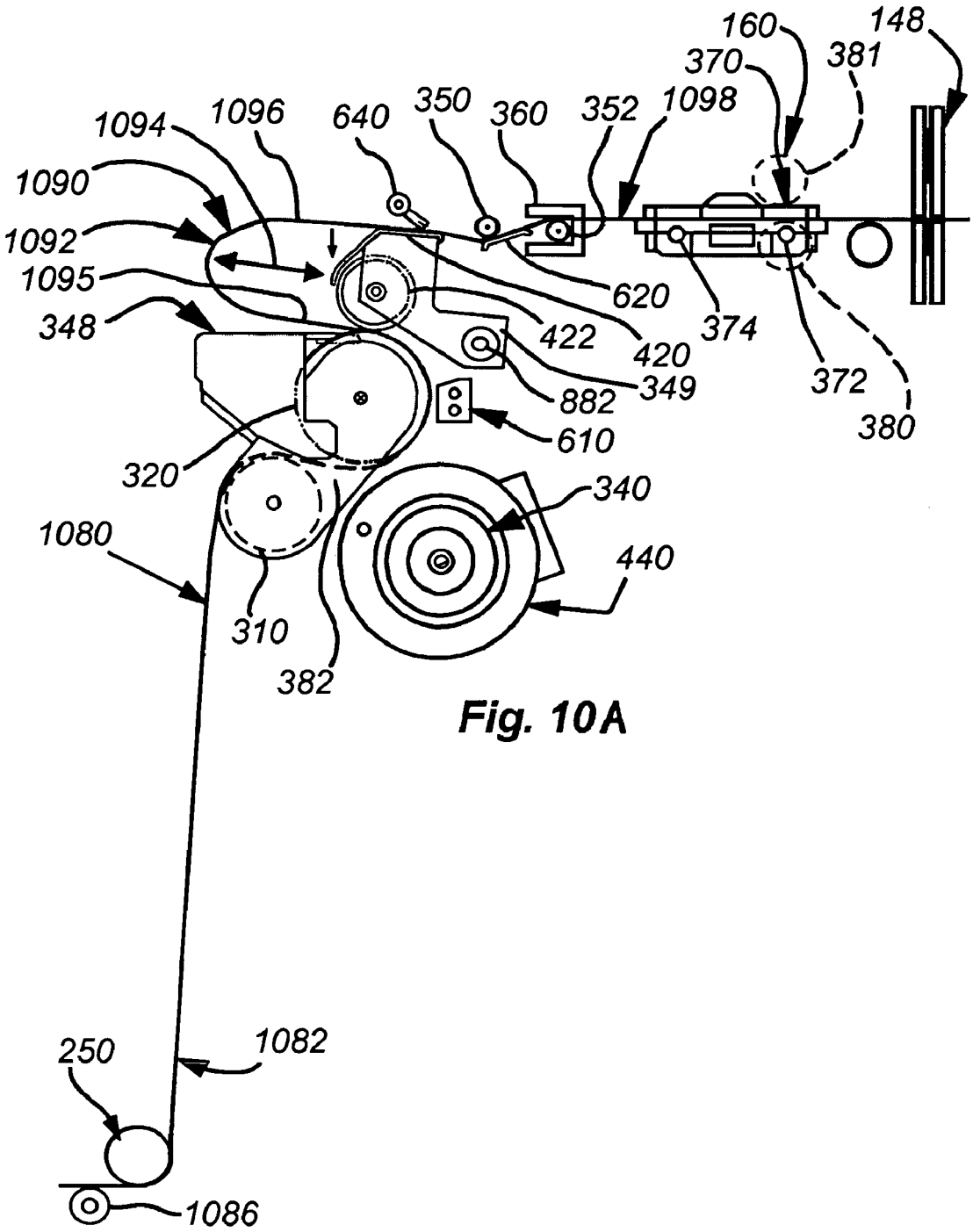
FIG. 10A is a side view showing the cutter of this invention feeding an optional moderately tensioned continuous web through the cutter element.

With brief reference to FIG. 10A, the overall feed path is shown in further detail including the tractor pin feed unit with its associated drive and nip rollers 380 and 160. In addition, the cutter element 148 is shown. In this version, the web 1080 includes a lower section 1082 that extends around a lower guide bar 1084 and through a secondary guide bar 1086 that can include a moving edge guide assembly. This is the optional, moderately tensioned infeed web configuration shown generally in FIG. 2. Loading of the moderately tensioned infeed web configuration is essentially identical to the above-described free feed loop configuration (as shown in FIG. 1). The arrangement of the horizontal buffer loop 1090 is also identical. It can be seen, in particular, in the case of a moderately tensioned web, where the buffer loop 1090 may provide significant isolation between the lower feed segment 1082 of the web and the upper segment 1098 which should enter the cutter element 148 in a registered and well-guided fashion.

Figure 11:
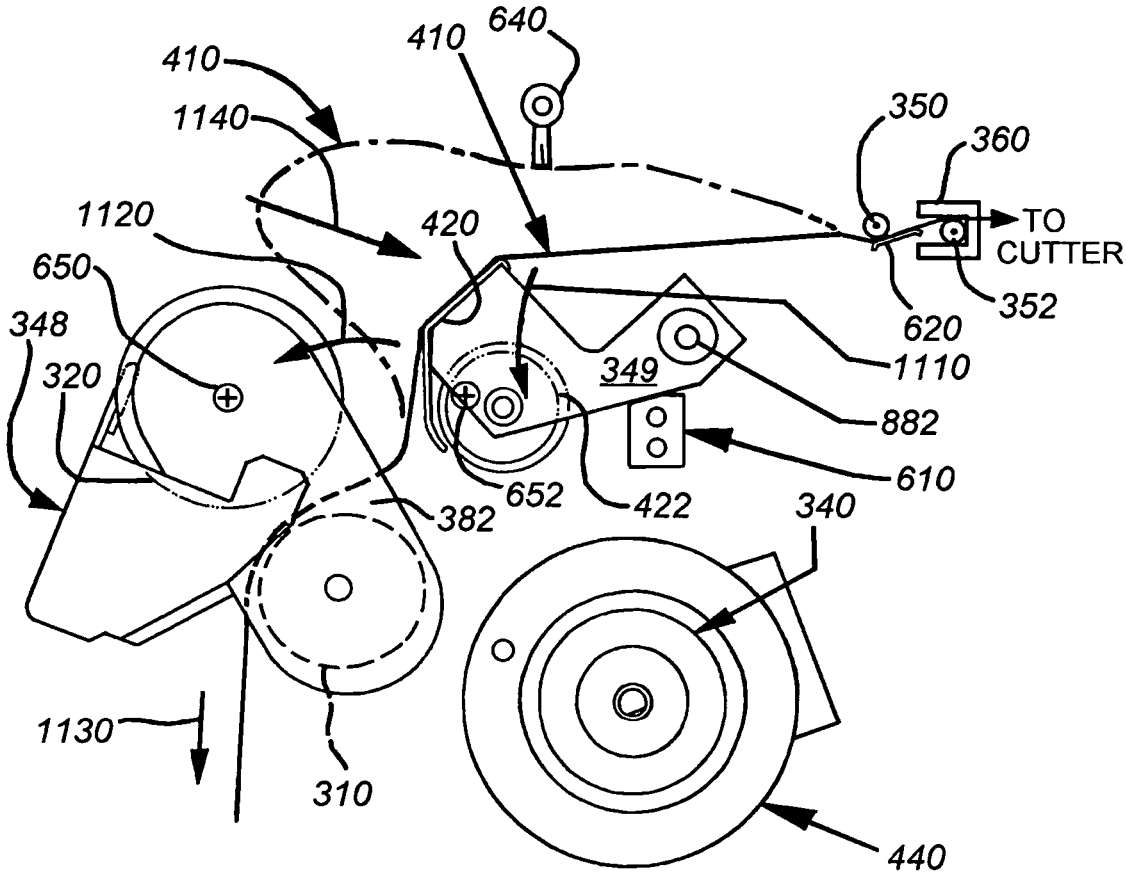
FIG. 11 is a side view of the elements of FIG. 7 showing the elements moving back into a loading orientation.

It should be clear that unloading of the web follows the reverse procedure to that of loading. In other words, the nip roller assembly 349 is raised by the clutch to allow the arm assembly 382 and roller 320 to swing out under operation of the actuator 382. The clutch is then released to allow the assembly to drop. This is shown in FIG. 11. As the assembly drops, the assembly's (349) top plate 420 is moved away from engagement with the brush assembly 640. Thus, the brush assembly 640 drops freely under action of its tension spring. The arm assembly 382 continues to move outwardly (arrow 1120) thereby moving the actual axis 650 away from the loaded axis 652. The web 410 relaxes its tension, dropping downwardly under its weight (arrow 1130) from it's loaded position (shown generally in phantom) to a more-straight path position as shown (solid lined). The opening of the unit 140, as shown in FIG. 11, can occur when a new web is to be loaded or, desirably, when the unit 140 is to remain idle for a predetermined period of time. For example, when the unit is brought to a complete stop, it may be opened as shown in FIG. 11. Likewise, when the unit is shut off, the controller may direct the unit to open automatically before final shut down occurs.

Figure 12:
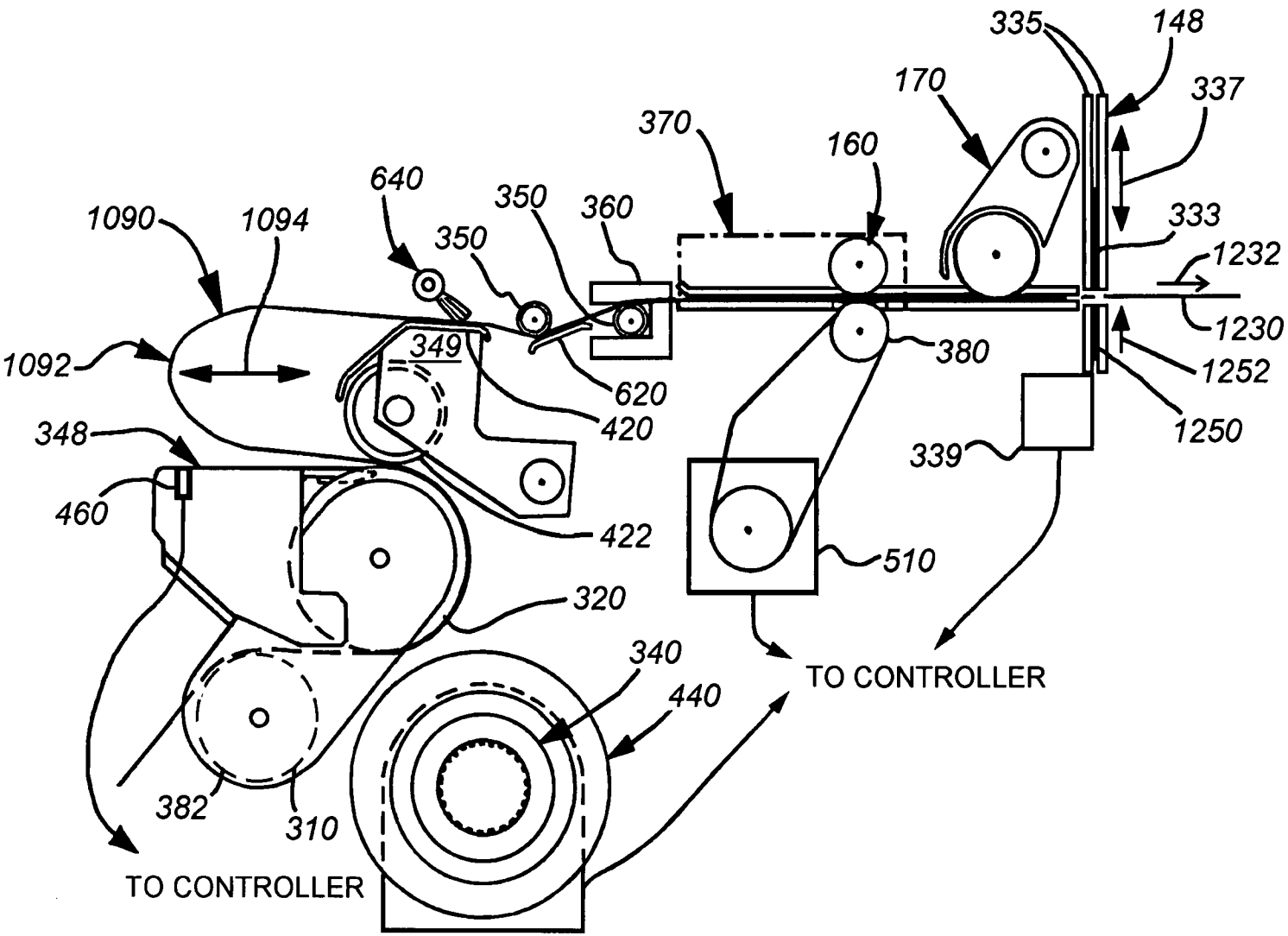
FIG. 12 is a side view of the operative elements of the infeed and indexing drive mechanisms in a loaded orientation.

FIG. 12 shows, generally, the elements described above for either the infeed free loop or the optional moderately tensioned web configuration operating in a steady state in which the horizontal buffer loop 1090 is regulated by the motors 440 and 510 so that the loop end 1092 remains within the edge of the field of the sensor 460. In this embodiment, a slitter 170 is employed to slit the wide web into two widthwise slit webs that each enter side-by-side into the cutter element 148. The knife 333 of the cutter element 148 is moved (double arrow 337) via a crank arm (not shown) by the above-described cutter element motor 339 to generate cut sheets 1230. Note a cutter base 1250 also moves upwardly (arrow 1252) during each cut under the power of the motor 339 to assist the cut by the knife 333. Various downstream rollers and conveyors can be provided to direct each of the cut sheets 1230 in a downstream direction (arrow 1232) into a justifier or other sheet utilization device.

Figure 13:
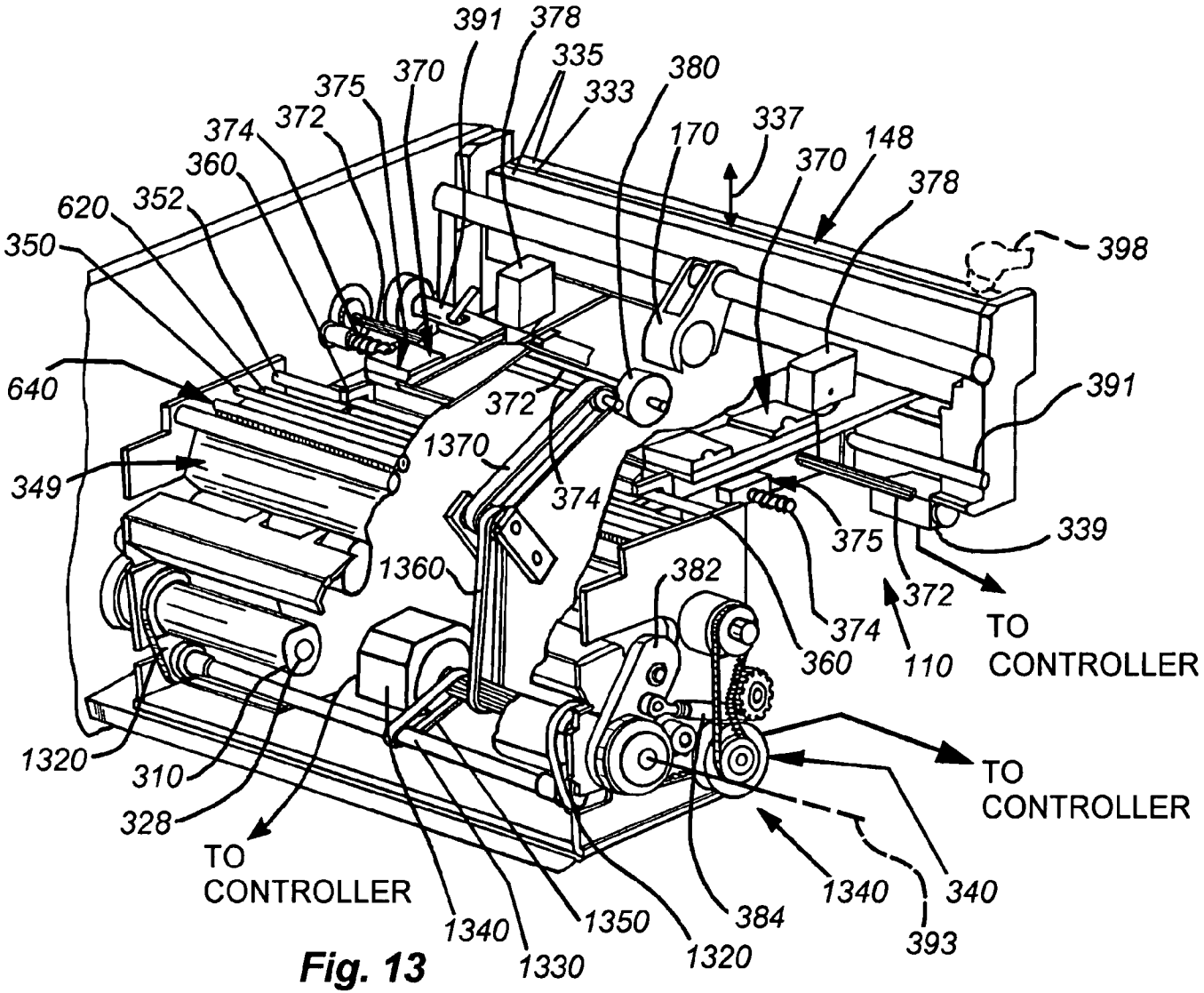
FIG. 13 is a cutaway perspective view of the edge guide movement mechanism according to an embodiment of this invention.

As described above, the cutter 110 of this invention is adapted to feed either a moderately tensioned web or a free loop input web from a source. FIG. 13 shows a configuration of the infeed unit 1340 for the overall cutter 110 in which the guide bar 310 has been fitted with moving edge guides 1320. The edge guides 1320 are moved by a threaded rod or shaft 1330 under operation of a stepper motor 1340 (or any other suitable type of motor) and associated belt 1350. The stepper motor 1340 is operated by the controller to automatically, or under operative control, change the width of the edge guides 1320. The edge guides move equal amounts outwardly and inwardly from a center line thus guaranteeing that the web remains centered within the cutter. The stepper motor also interconnects via belts 1360 and 1370 to the lead screw 374. As described above, the lead screw 374 drives the tractor pin feed units 370 along the splined driven rod 372 (FIG. 3 above) inwardly and outwardly in conjunction with the edge guides 320. The interconnected edge guides 360 are mounted to the front of the tractor pin feed units and also move along the guide bar 352 to provide edge guiding as the web passes out of the guide bar assembly 350 and 352. Edge guide adjustment, as noted above, can be provided in a variety of ways. It can be provided automatically by sensing the width of the web using a series of sensors located at a predetermined position along the cutter or another element of the system. Alternatively, the operator can input the web width manually to the controller, allowing the controller to move the edge guides to the appropriate sides. Manual input can be the actual size of the web, input is a numerical value, or can simply involve the toggling of the stepper motor 1340 until the appropriate size is attained through visual inspection.

Figure 14:
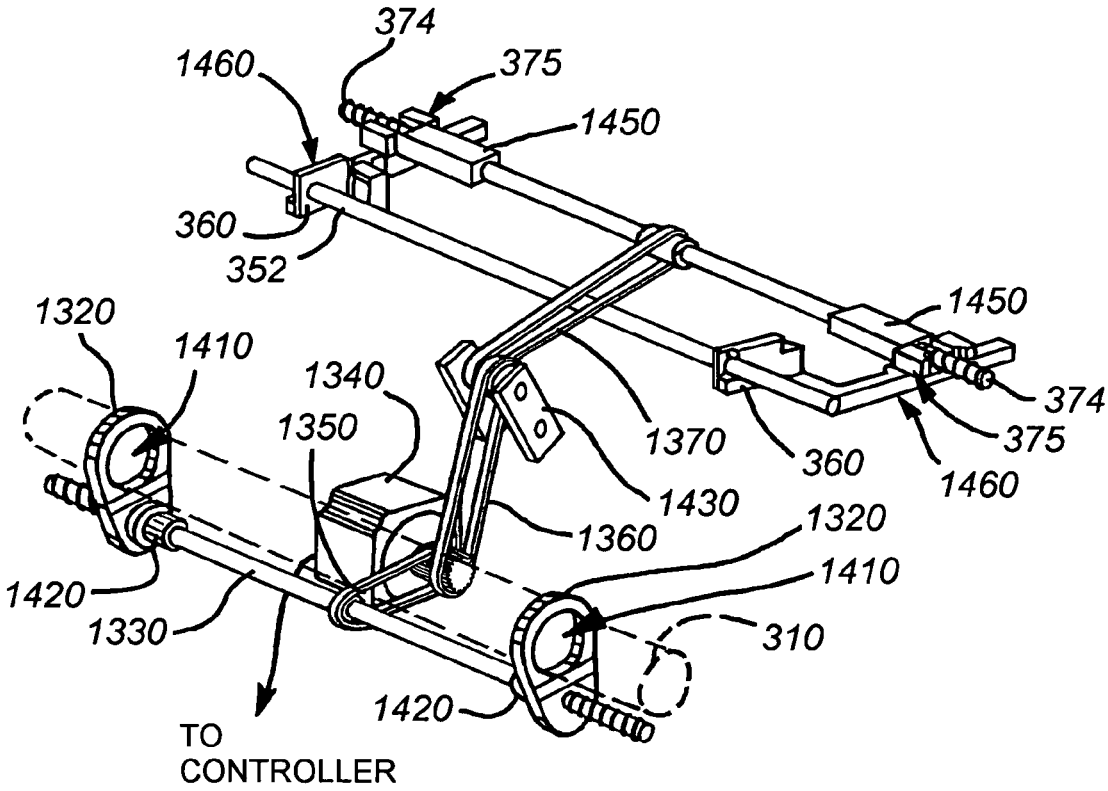
FIG. 14 is a more detailed perspective view of the edge guide moving mechanism adapted for free loop infeed according to an embodiment of this invention.
Figure 15:
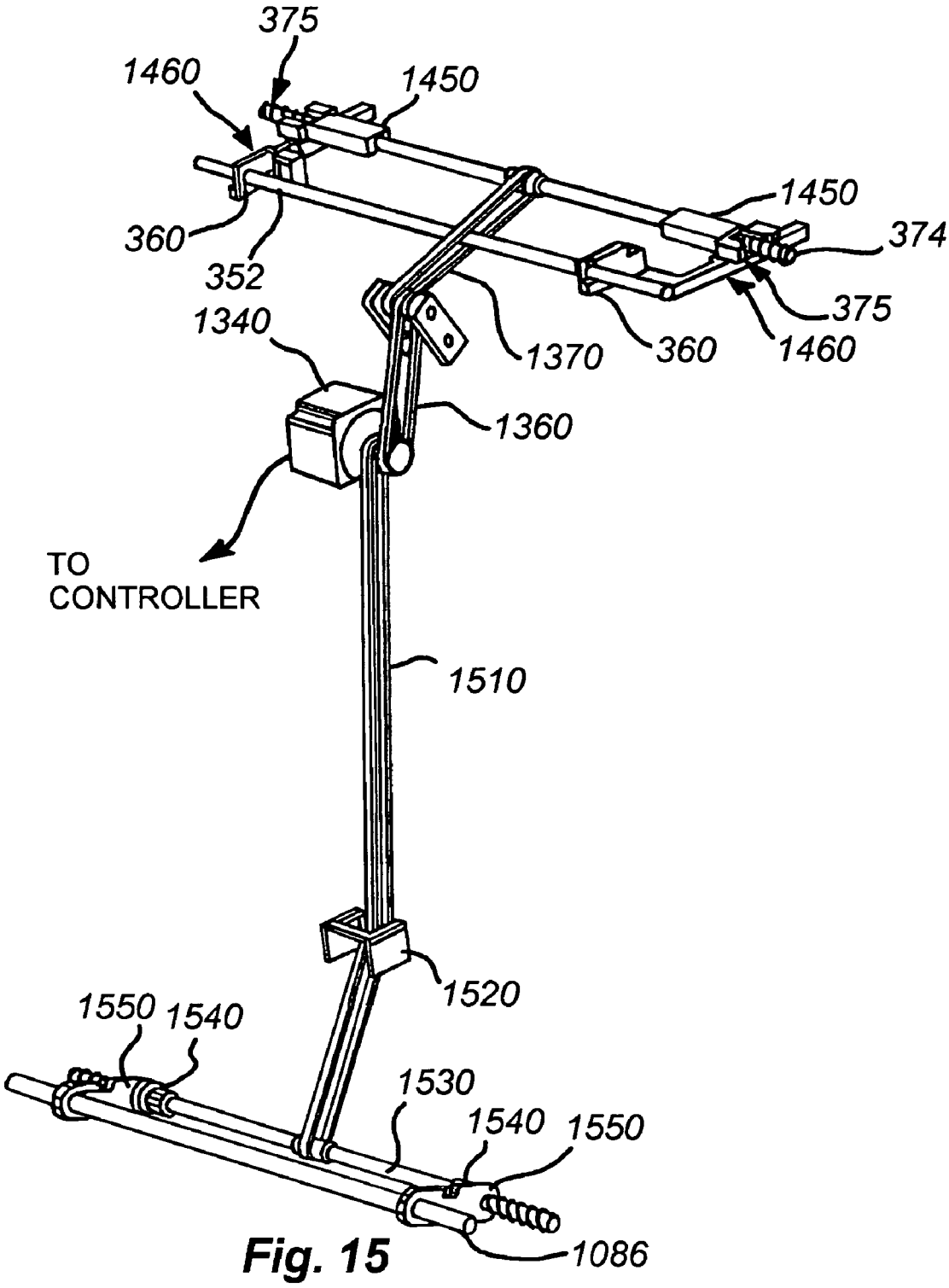
FIG. 15 is a more detailed perspective view of the edge guide movement mechanism adapted for moderately tensioned web infeed according to an embodiment of this invention.

FIGS. 14 and 15 respectively show in greater detail the free loop web and optional, moderately tensioned web edge guide configurations that can be implemented in the cutter according to various embodiments.

As shown in FIG. 14, the edge guides 1320 include enlarged orifices 1410 that ride on the large-diameter guide bar 310 (shown in phantom). A pair of threaded blocks or nuts 1420 engage the threaded rod or lead screw 1330. The pitch of the thread is selected so that movement occurs at a predetermined speed and precision relative to a given movement speed of the belt 1350. The upper belts 1360 and 1370 are joined at a connecting pulley assembly 1430. This can be omitted in certain embodiments. The lead screw 374 (FIG. 3 above) engages threaded blocks or nuts 1450 on the above-described nut assembly 375 that are part of a carriage assembly 1460 for each tractor pin feed mechanism (omitted in this illustration—tractor pin feed units 370 in FIG. 3 above). The drive shaft of the tractor pin feed elements can be splined so that the tractor pin feed elements may be rotated as the carriages 1460 slide inwardly and outwardly to adjust the relative spacing of the tractor pin feed units (370). Note that, while a series of belts are used to interconnect the stepper motor 1340 to the edge guides, it is expressly contemplated that gears or other connecting members can be substituted in alternate embodiments.

Finally, FIG. 15 shows an alternate arrangement of edge guide drive components in which the guide bar (310) edge guides 1320 are omitted. In general, it is desirable only to guide the edges of the web at certain points. This prevents misalignment, binding, excessive friction. In the optional, moderately tensioned web configuration (see FIG. 10A), the edge guide is provided with respect to the lower guide bar assembly 250. The upper interconnection with the tractor pin feed carriages 1460 is unchanged in the moderately tensioned web configuration. However, the stepper motor is now interconnected with an elongated belt 1510 that passes through a sheave 1520 to a lower threaded bar or lead screw 1530. The lead screw 1530 is engaged by a pair of threaded blocks or nuts 1540 mounted on opposing edge guides 1550. The edge guides 1550 ride along the lower guide rod 1086 to provide appropriate positioning of the web at its lower end where it passes around the guide bar 250 (see FIG. 10A). While not shown, a variety of quick-release mechanisms and other components can be employed to select between edge guiding at the upper guide bar 310 or the lower guide bar 250 as appropriate.

A variety of other attachment and options can be provided according to alternate embodiments. For example as shown in FIGS. 3 and 13, an optional airflow (positive pressure or vacuum) device can be provided to remove web dust generated by the cutting process. Other additions or variations to the drive and cutting mechanism are also contemplated.

The foregoing has been a detailed description of illustrative embodiments of the invention. Various modifications and additions can be made without departing from the spirit and scope thereof. For example, the arrangement of motors and other drive elements shown is subject to variation. Use of linear actuators, as opposed to other components is exemplary only. The size and shape of rollers and their approximate location can be varied. In addition, the type and location of the cutter element can be varied. It is also expressly contemplated that the overall system described herein can include a variety of different source devices and downstream sheet-handling devices. Such devices can include printers, stackers, folders, embossers, sorters, binders and rollers in any combination. Accordingly, this description is meant to be taken only by way of example and not to otherwise limit the scope of the invention.

What is claimed is:

1. A system for cutting continuous web into sheets comprising:

an infeed unit having an infeed drive for directing web from a source to a first location, the first location being constructed and arranged to accommodate a buffer loop arranged to extend in an approximately horizontal direction;

an indexing drive for directing the web from the first location to a cutter element; and a controller that operates at least one of the infeed drive and the indexing drive to maintain the buffer loop within a predetermined size range;

wherein the infeed drive comprises an infeed drive roller that rotates about a pivot inwardly into a loaded position and outwardly to an unloaded position and a nip roller constructed and arranged to pivot about a pivot between an engaged position with the nip roller in engagement with the web and a disengaged position with the nip roller out of engagement with the web said infeed drive being configured and arranged such that the web assumes an S-wrap configuration with the top part of the S-wrap extending out into the horizontal buffer loop above the infeed drive roller when the infeed drive roller is in its loaded position and the nip roller is in its engaged position.

2. The system as set forth in claim 1 further comprising edge guides located downstream of the first location and being slidable toward and away from each other and edge guides located on a guide bar adapted to direct the web into an infeed drive roller of the infeed drive from a free loop orientation between the guide bar and the web source, the guide bar including edge guides located slidably thereon so as to move toward and away from each other and further comprising a width adjustment motor operatively connected to the edge guides on the guide bar and the edge guides downstream of the first location for moving the edge guides toward and away from each other.

3. The system as set forth in claim 1 wherein the cutter element comprises a guillotine-type cutter with a moving knife adapted to cut a momentarily paused web.

4. The system as set forth in claim 3 wherein the indexing drive is constructed and arranged to drive the web at an approximately constant speed and to momentarily pause driving of the web to present a web separation location to the cutter element.

5. The system as set forth in claim 1 wherein the infeed drive roller is mounted on an arm assembly that rotates inwardly into the loaded position and outwardly into the unloaded position and the nip roller is mounted on a nip roller assembly that pivots between the engaged position with the nip roller in the loaded position and the disengaged position out of interfering contact with the web when the infeed drive roller is in the unloaded position.

6. The system as set forth in claim 5 further comprising a linear actuator for moving the arm assembly between the loaded position and the unloaded position.

7. The system as set forth in claim 6 further comprising an infeed drive motor that drives the infeed drive roller and that is operatively interconnected by a clutch to the nip roller, wherein the controller is constructed and arranged to engage the clutch to pivot the nip roller at predetermined times during movement of the arm assembly between the loaded position and the unloaded position.

8. The system as set forth in claim 7 further comprising a guide bar around which the web wraps located between a source of the web and the infeed drive roller.

9. The system as set forth in claim 8 further comprising an indexing drive motor, the indexing drive motor being interconnected with an indexing drive roller and an indexing drive nip roller located upstream of the cutter element.

10. The system as set forth in claim 9 further comprising tractor pin feed units interconnected with the indexing drive motor, the tractor pin feed units being mounted on a linear positioning device so as to slide toward and away from each other.

11. The system as set forth in claim 10 wherein the tractor pin feed units include, on upstream edges thereof, edge guides for engaging side edges of the web as it passes out of the first location.

12. The system as set forth in claim 11 further comprising a width adjustment motor operatively connected to the tractor pin feed units so as to vary a separation of the tractor pin feed units from each other.

13. The system as set forth in claim 12 further comprising a guide bar around which the web wraps located between a source of the web and the infeed drive roller.

14. The system as set forth in claim 13 further comprising a pair of edge guides located on the guide bar and being operatively connected to the width adjustment motor so as to slidably adjust the edge guides along the guide bar.

15. The system as set forth in claim 1 wherein the first location includes a web sensor operatively connected to the controller, and wherein the controller is constructed and arranged to maintain an end of the loop in proximity to the sensor.

16. The system as set forth in claim 15 wherein the infeed drive roller comprises an elastomeric roller and the nip roller comprises a metallic roller.

17. The system as set forth in claim 1 further comprising edge guides located downstream of the first location and being slidable toward and away from each other and edge guides located on a guide bar positioned upstream of the infeed unit adjacent to a base of the system to direct the web in a tensioned orientation from the web source, the guide bar including edge guides located slidably thereon so as to move toward and away from each other and further comprising a width adjustment motor operatively connected to the edge guides on the guide bar and the edge guides downstream of the first location for moving the edge guides toward and away from each other.

18. The system as set forth in claim 17 wherein the adjustment motor is operatively connected to a threaded lead screw upon which the edge guides downstream of the first location and the edge guides on the guide bar are attached.

19. The system as set forth in claim 17 further comprising a guide bar, free of edge guides, located downstream of the guide bar having edge guides and being adapted to direct the web into an infeed drive roller of the infeed drive.

20. The system as set forth in claim 17 wherein the controller is adapted to move the arm assembly to the unloaded position when the system is in a predetermined operating state.

21. The system as set forth in claim 20 wherein the predetermined operating state comprises an idle state in which web is stationary within the system.

22. The system as set forth in claim 1 wherein the web enters the infeed unit from a source that includes a driven web roll.

23. The system as set forth in claim 22 wherein the web exits the cutter element as sheets and further comprising a utilization device for handling the sheets.

24. The system as set forth in claim 23 wherein the utilization device comprises at least one of a sheet justifier, printer and folder.

* * * * *